US009932795B2

(12) United States Patent
Holland, Jr. et al.

(10) Patent No.: US 9,932,795 B2
(45) Date of Patent: Apr. 3, 2018

(54) LATERAL SEAL FOR BLOWOUT PREVENTER SHEAR BLOCKS

(71) Applicant: Axon EP, Inc., Houston, TX (US)

(72) Inventors: William Rinehart Holland, Jr., Spring, TX (US); Jess W. Shows, Houston, TX (US); Bradford S. Franks, Alvin, TX (US)

(73) Assignee: Axon Pressure Products, Inc., Houston, TX (US)

( * ) Notice: Subject to any disclaimer, the term of this patent is extended or adjusted under 35 U.S.C. 154(b) by 206 days.

(21) Appl. No.: 14/846,220

(22) Filed: Sep. 4, 2015

(65) Prior Publication Data

US 2017/0067308 A1 Mar. 9, 2017

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/062; E21B 33/063
See application file for complete search history.

(56) References Cited

U.S. PATENT DOCUMENTS 5,515,916 A * 5/1996 Haley ..... E21B 33/063 166/55

* cited by examiner

*Primary Examiner* — Sean D Andrish
(74) *Attorney, Agent, or Firm* — Baker Botts L.L.P.

(57) ABSTRACT

Present embodiments of the disclosure are directed to a seal assembly for generating a seal between two opposing shear blades of a ram unit after shearing a tubular. The seal assembly may include at least a wiper, a sealing element, and an energizer. The wiper may clean a surface of a shear blade as the blade moves relative to the seal assembly. The sealing element may include an elastomeric material that can be deformed into engagement with the shear blade to generate the seal. The energizer may be a hard component that energizes the sealing element against the cleaned surface of the shear blade as the blade moves further relative to the seal assembly. The wiper may clean the sealing surface of the blade by removing debris from the surface prior to the energizer activating the seal.

19 Claims, 6 Drawing Sheets

LATERAL SEAL FOR BLOWOUT PREVENTER SHEAR BLOCKS

TECHNICAL FIELD

Embodiments of the present disclosure relate generally to blowout preventers, and more specifically, to an improved lateral seal for shear blocks in a blowout preventer ram unit.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light and not as admissions of prior art.

Blowout preventers are used extensively throughout the oil and gas industry. Typical blowout preventers include a main body to which are attached various types of ram units. The two categories of blowout preventers that are most prevalent are ram blowout preventers and annular blowout preventers. Blowout preventer stacks frequently utilize both types, typically with at least one annular blowout preventer stacked above several ram blowout preventers. The ram units in ram blowout preventers allow for both the shearing of the wellbore tubular and the sealing of the blowout preventer. Typically, a blowout preventer stack may be secured to a wellhead and may provide a means for sealing the well in the event of a system failure.

Existing ram units often include shear blocks or shear blades designed to be forced together to shear the wellbore tubular and seal the blowout preventer. The shear blocks generally feature opposing blade profiles used to cut the wellbore tubular. It is desirable to provide an effective seal between the opposing shear blocks to help seal the blowout preventer.

SUMMARY

In accordance with an embodiment of the present disclosure, a blowout preventer includes a ram unit including a first shear blade and a second shear blade. The ram unit is configured to force the first shear blade and the second shear blade together to shear and seal a wellbore tubular disposed within the ram unit. The second shear blade includes a seal assembly for sealing a space between the first shear blade and the second shear blade in response to the ram unit forcing the first shear blade and the second shear blade together. The seal assembly includes a wiper to clean a surface of the first shear blade, a sealing element to generate a seal between the surface of the first shear blade and the second shear blade, and an energizer to energize the sealing element against the surface of the first shear blade.

In accordance with another embodiment of the present disclosure, a method includes actuating a ram unit of a blowout preventer to move a first shear blade of the ram unit and a second shear blade of the ram unit toward each other. The method also includes cleaning a surface of the first shear blade via a wiper of a seal assembly disposed on the second shear blade, in response to the first shear blade moving relative to the second shear blade. The method further includes energizing a sealing element of the seal assembly against the surface of the first shear blade via an energizer of the seal assembly in response to the first shear blade moving relative to the second shear blade. Still further, the method includes sealing the first and second shear blades against one another via the sealing element.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

One or more specific embodiments of the present disclosure will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Generally, embodiments of the disclosure are directed to a blowout preventer having a ram unit designed to shear and seal wellbore tubulars. The ram unit may include a first shear blade and a second shear blade designed to be moved towards each other to shear a wellbore tubular. The presently disclosed embodiments are directed to a lateral seal assembly that may be used to generate a seal between the shear blades after they are closed to shear the tubular. The seal assembly may be disposed on the second shear blade. The seal assembly may include at least a wiper, a sealing element, and an energizer packaged as a single seal assembly. The wiper may include a hard component for cleaning a surface of the first shear blade as the blade moves relative to the second shear blade. The sealing element may include an elastomeric material that may be deformed into a sealing engagement with the first shear blade to generate the seal. The energizer may be a hard component that energizes the sealing element against the cleaned surface of the first shear blade as the blade moves further relative to the second shear blade.

The wiper is used to clean the sealing surface of the shear blade by removing oil, cuttings, and debris from the surface prior to the energizer activating the seal, thus enabling a more secure seal to be established on the blade surface. Therefore, the disclosed system and method may provide effective sealing of the shear blades and any tubulars disposed therein.

Figure 1:
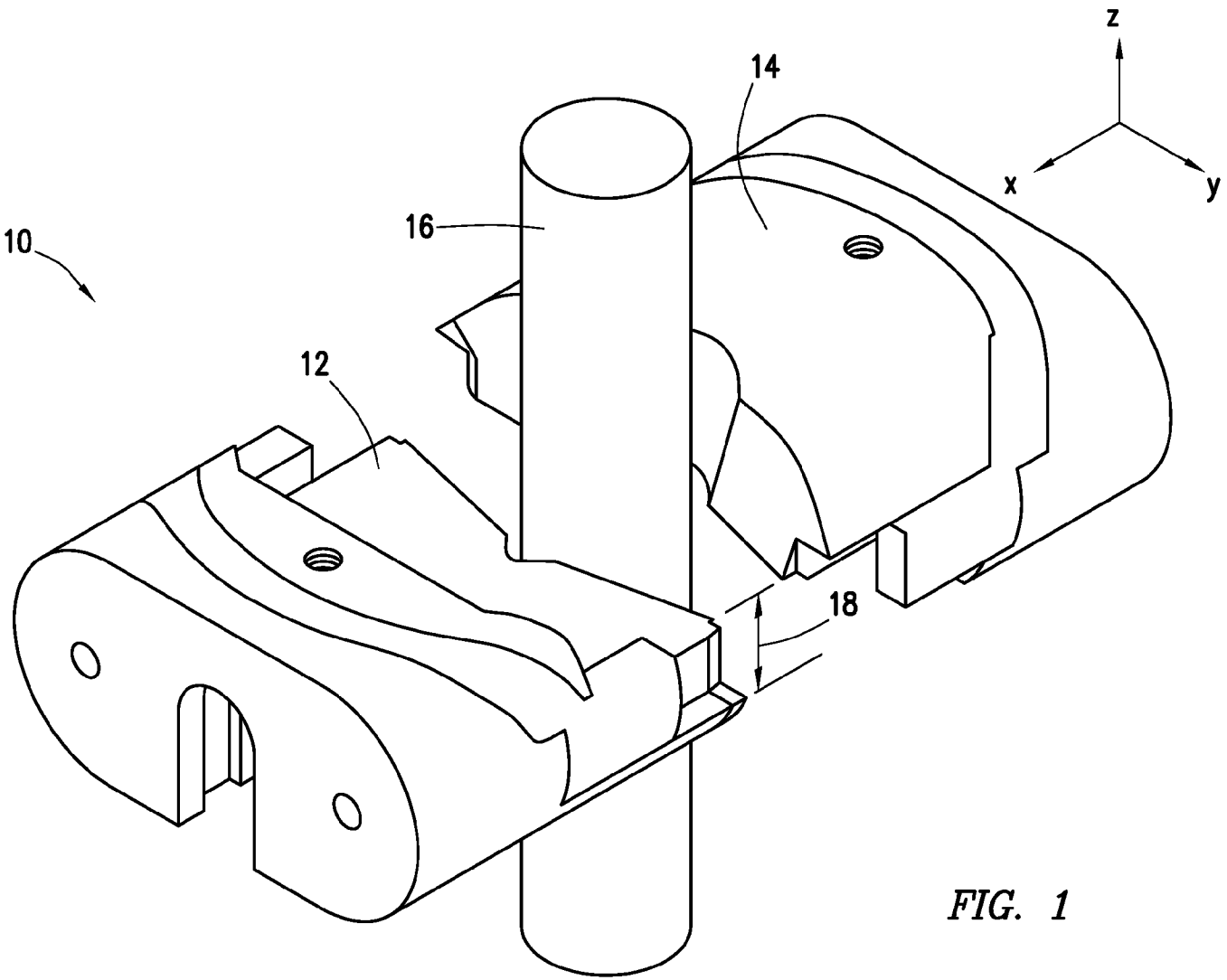
FIG. 1 is a perspective view of opposing shear blades of a blowout preventer ram unit disposed around a wellbore tubular, in accordance with an embodiment of the present disclosure.

Turning now to the drawings, FIG. 1 illustrates certain components of a ram unit 10 that can be used in a blowout preventer. The ram unit 10 may include two opposing shear blades 12 and 14 designed to be actuated together via one or more actuation components of the ram unit 10 to shear a wellbore tubular 16 and seal the blowout preventer. The wellbore tubular 16 may be generally positioned between the shear blades 12 and 14 of the blowout preventer. The wellbore tubular 16 may be a joint or string of drill pipe, casing, production tubing, or some other tubular component extending into a wellbore formed through a subterranean formation. During normal drilling, completion, and production operations at a well site, the shear blades 12 and 14 may be held in open positions separated from one another to allow the wellbore tubular 16 to pass through the blowout preventer. In the event of a system failure downhole, the blowout preventer may actuate the shear blades 12 and 14 toward each other and into shearing engagement with the wellbore tubular 16. This may cause the ram unit 10 to close and seal the wellbore tubular 16.

As illustrated, the shear blades 12 and 14 may be vertically offset from one another, as shown in FIG. 1. That is, a bottom surface of one shear blade 12 may be positioned vertically lower than a bottom surface of the other shear blade 14. The shear blades 12 and 14 may be offset by a certain distance 18 such that an upper surface of the lower shear blade 12 may be positioned at or just below the bottom surface of the upper shear blade 14. This allows the shear blades 12 and 14 to move past each other at the point where a leading edge of each of the shear blades 12 and 14 contacts and shears the wellbore tubular 16.

In the illustrated embodiments, each of the shear blades 12 and 14 may include a specific blade profile designed to shear the wellbore tubular 16 in an efficient manner. For example, the blade profiles may include concave cutouts toward the center of the shear blade profiles, as shown. In some embodiments, the blade profiles for the opposing shear blades 12 and 14 may be different from one another. However, it should be noted that in other embodiments the shear blades 12 and 14 may each feature the same blade profile, or any desired combination of blade profiles.

Figure 2:
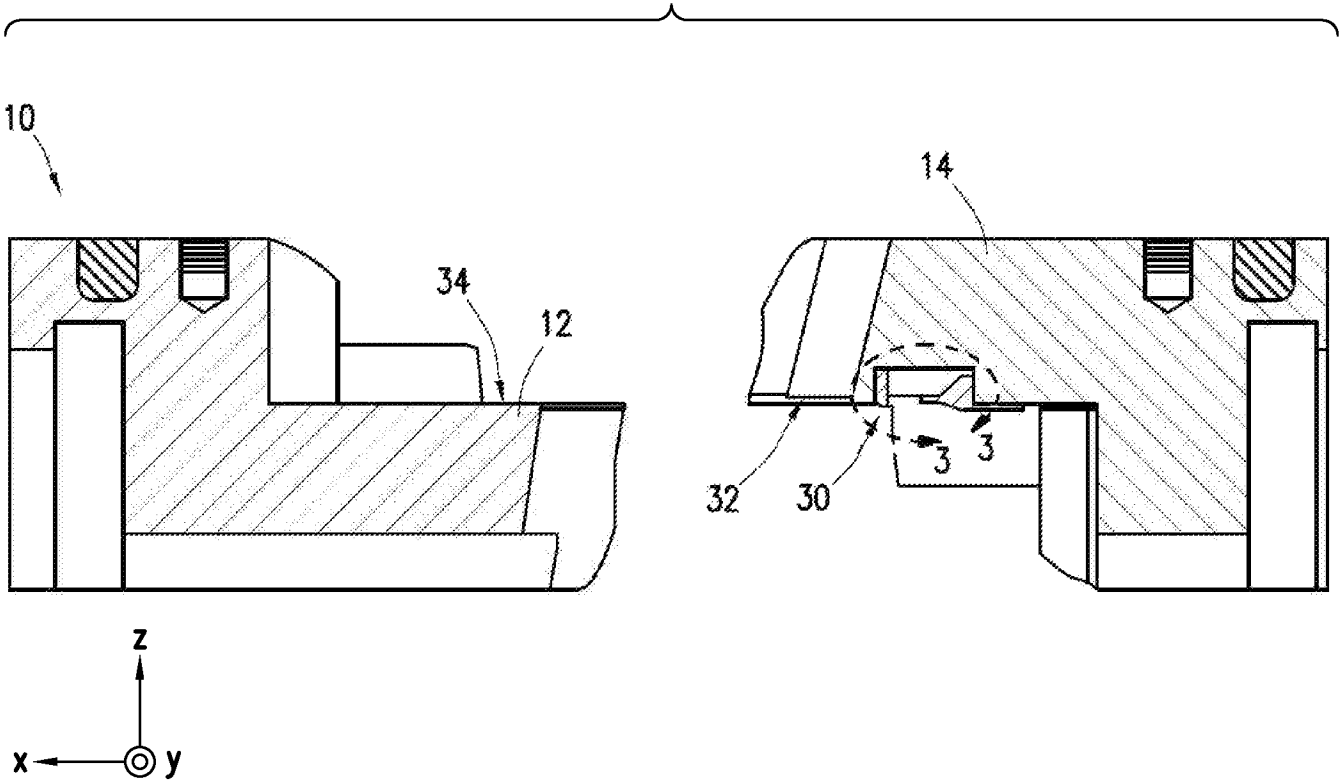
FIG. 2 is a cutaway view of the opposing shear blades of FIG. 1 having a lateral seal, in accordance with an embodiment of the present disclosure.

FIG. 2 illustrates a side cutaway view of the ram unit 10 of FIG. 1. When the ram unit 10 brings the shear blades 12 and 14 together to shear the wellbore tubular, the shear blades 12 and 14 may overlap (e.g., shear blade 14 directly over shear blade 12) to fully close off the wellbore tubular. The disclosed ram unit 10 may include a seal assembly 30 disposed on one or both of the shear blades 12 and 14 to facilitate effective sealing of the space between the overlapping shear blades 12 and 14 once they are closed. The seal assembly 30 may provide a fluid-tight seal extending along an entire width of the shear blades 12 and 14 to prevent fluid or other debris from the wellbore from reaching the surface, e.g., in the event of a kick or other well event. It should be noted that the seal assembly 30 is not limited to use with the specifically illustrated shear blades 12 and 14, but may be used with any arrangement, orientation, and/or type of shear blades designed to shear and seal a wellbore tubular.

As shown, the seal assembly 30 may be disposed on just one of the shear blades of the ram unit 10. For example, in the illustrated embodiment the seal assembly 30 is generally disposed on a lower side 32 of the upper shear blade 14 and designed to interface with an upper side 34 of the lower shear blade 12 when the shear blades 12 and 14 are brought together. In other embodiments, the seal assembly 30 may be disposed on the upper face 34 of the lower shear blade 12 to interface with the lower surface 32 of the upper shear blade 14.

In still other embodiments, each of the blades 12 and 14 may be equipped with their own seal assembly 30 for interfacing with the opposing blades 14 and 12. In such instances, it may be desirable for the seal assemblies 30 to be positioned on the shear blades 12 and 14 such that, when the shear blades 12 and 14 are brought together to shear and seal the wellbore tubular, the activated seal assemblies 30 are laterally offset from one another. This may enable each of the seal assemblies 30 to interface directly with an opposing shear blade surface.

Figure 3A:
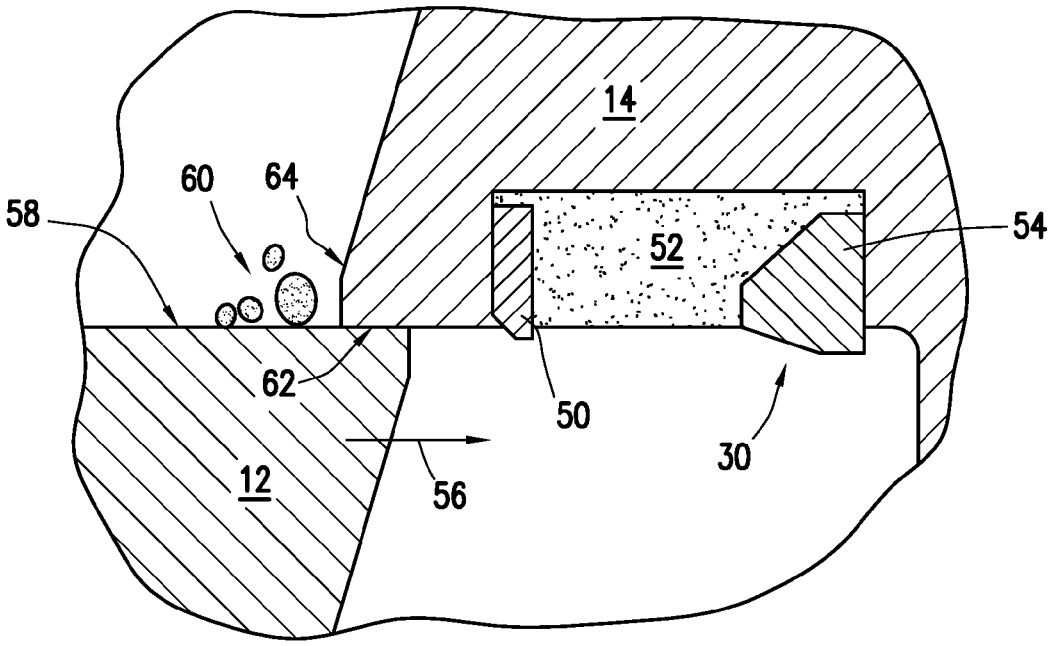
FIGS. 3A-3C are cross sectional views of the lateral seal of FIG. 2 taken along lines 3-3 being used to clean and seal a surface of a first shear blade with respect to a second shear blade, in accordance with embodiments of the present disclosure.
Figure 3B:
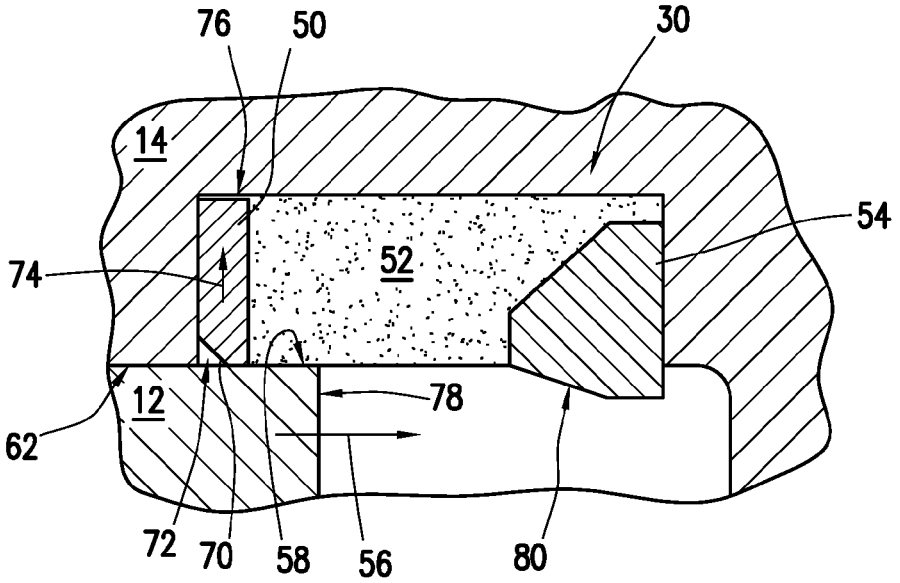
Figure 3C:
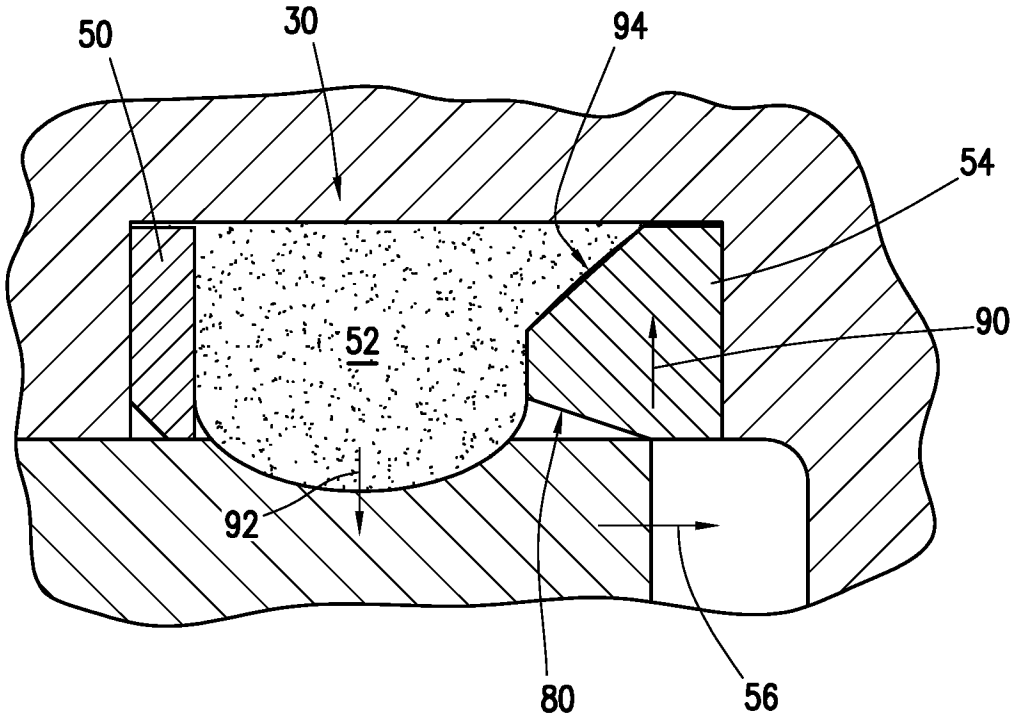

FIGS. 3A-3C provide a more detailed view of the seal assembly 30 and how the seal assembly components work together to form an improved fluid-tight seal between the shear blades 12 and 14. In the illustrated embodiment, the seal assembly 30 may be disposed in the upper shear blade 14 to seal a space between the shear blades 12 and 14 in response to the ram unit forcing the shear blades 12 and 14 together. The seal assembly 30 may include a wiper 50, a sealing element 52, and an energizer 54. As described below, the wiper 50 may be used to clean a surface of the opposing shear blade (e.g., 12), the sealing element 52 may generate the effective seal between the shear blades 12 and 14, and the energizer 54 may be used to energize the sealing element 52 against the surface of the opposing shear blade 12.

All of the functions provided by the seal assembly 30 may be performed in response to the shear blades 12 and 14 being brought together by the ram unit. It should be noted that this movement of the shear blades 12 and 14 may be brought on by the ram unit physically moving just the shear blade 12 toward a stationary shear blade 14, just the shear blade 14 toward a stationary shear blade 12, or both of the shear blades 12 and 14 toward each other. In each instance, the net movement of the shear blades 12 and 14 may be represented as the shear blade 12 moving laterally in the direction of arrow 56 with respect to the shear blade 14 having the seal assembly 30. This lateral movement 56 of the shear blade 12 may initiate and facilitate the cleaning/sealing functions of the seal assembly 30, as described in detail below.

In FIGS. 3A-3C, the operations of the shear blades 12 and 14 and the seal assembly 30 are shown. FIG. 3A illustrates the ram unit components as the shear blade 12 begins to move laterally (arrow 56) relative to the shear blade 14 having the seal assembly 30. This may occur at the beginning of actuation of the one or more shear blades 12 and 14 via the ram unit.

Once the shear blade 12 laterally overlaps the shear blade 14, the system may begin clearing debris from a sealing surface 58 of the shear blade 12. The sealing surface 58 is a surface of the shear blade 12 that the seal assembly 30 may clean and then engage with the sealing element 52 to form the seal. As shown, relatively large debris 60 may be removed from the sealing surface 58 via the overlapping shear blades 12 and 14. The debris 60 may be so large that it cannot fit through a space 62 between the overlapping shear blades 12 and 14. As the shear blade 12 moves relative to the shear blade 14 in the direction of arrow 56, the large debris 60 on the sealing surface 58 may become caught on a surface 64 of the shear blade 14. This surface 64 may slope substantially upward from the lateral direction 56 of movement of the shear blade 12, which helps to trap the debris 60 in a space between the two shear blades 12 and 14.

Although the shear blades 12 and 14 themselves may be effective at cleaning large debris 60 from the sealing surface 58, additional small debris, cuttings, and oil may remain on the sealing surface 58 after this initial pass by the shear blade 14. As shown in FIG. 3B, the wiper 50 of the seal assembly 30 may be utilized to substantially remove the remaining debris, cuttings, and oil from the sealing surface 58 of the shear blade 12. Before the shear blade 12 reaches the wiper 50 of the seal assembly 30, the wiper 50 may extend beyond the surface of the shear blade 14 in a direction (e.g., downward) away from the shear blade 14. This extension of the wiper 50 is shown in FIG. 3A. That way, as the shear blade 12 moves laterally (arrow 56) relative to the shear blade 14, the shear blade 12 may engage the wiper 50 without directly contacting the lower surface of the shear blade 14.

As the shear blade 12 moves relative to the seal assembly 30, the wiper 50 may engage and clean the sealing surface 58 of the shear blade 12, as illustrated in FIG. 3B. The wiper 50 may clean the sealing surface 58 by removing undesirable debris, cuttings, and/or oil. Such debris might otherwise prevent a seal from fully forming against the sealing surface 58 if it were not removed. The wiper 50 may be constructed from a relatively hard and tough material, such as steel. This may enable the wiper 50 to resist cuttings on the sealing surface 58 of the shear blade 12 and to remain effective after extended wear.

As shown, the wiper 50 may include a relatively flat lower surface for engaging and cleaning the sealing surface 58 of the shear blade 12. In addition, the wiper 50 may include a sloped surface 70 formed on an end of the wiper 50 extending toward the shear blade 12. The sloped surface 70 may help to define a relatively small pocket 72 between the shear blade 14, the shear blade 12, and the wiper 50. This pocket 72 may collect the debris, cuttings, and/or oil that is removed from the sealing surface 58 via the wiper 50. If the pocket 72 fills with debris, any additional debris removed via the wiper 50 may be pushed into the small space 62 between the two shear blades 12 and 14.

As the shear blade 12 moves laterally (e.g., arrow 56) along the seal assembly 30, the shear blade 12 may contact the wiper 50 and force the wiper 50 in a direction (e.g., upward) away from the shear blade 12, as shown by arrow 74. The sloped surface 70 of the wiper 50 may facilitate this transition from the lateral force of the shear blade 12 against the wiper 50 to the vertical movement 74 of the wiper 50. A portion 76 of the sealing element 52 may be disposed between an end of the wiper 50 (opposite the sloped surface end) and the shear blade 14. This portion 76 of the sealing element 52 may cushion the vertical movement of the wiper 50 as the shear blade 12 moves past the wiper 50. In addition, the portion 76 of the sealing element 52 may be relatively resistant to movement, thereby biasing the wiper 50 toward the shear blade 12. That way, as the shear blade 12 moves laterally past the wiper 50, the wiper 50 may be biased toward the shear blade 12 to continuously clean the sealing surface 58.

Again, as the shear blade 12 moves laterally relative to the seal assembly 30, the wiper 50 may clean the sealing surface 58 of the shear blade 12 starting at a leading edge 78 of the shear blade 12. As the shear blade 12 continues to move laterally with respect to the seal assembly 30, the cleaned section of the sealing surface 58 may move under the sealing element 52 of the seal assembly 30. At this time, the sealing surface 58 may be separated from the sealing element 52 by a certain distance. Even when the wiper 50 is pushed against the portion 76 of the sealing element 52 as shown in FIG. 3B, the wiper 50 may extend further from the shear blade 14 than the sealing element 52. This allows the shear blade 12 to be positioned such that a large portion of the sealing surface 58 is cleaned and disposed under the sealing element 52 prior to energizing the sealing element 52 to seal the shear blades 12 and 14. At some point in the movement of the shear blade 12 relative to the seal assembly 30, the leading edge 78 of the shear blade 12 may contact a sloped surface 80 of the energizer 54 to initiate movement of the energizer 54 to push the sealing element 52 into contact with the cleaned sealing surface 58.

FIG. 3C illustrates the energizer 54 being pushed against the sealing element 52 by the shear blade 12 to energize the sealing element 52 against the sealing surface of the shear blade 12. As the shear blade 12 moves laterally (e.g., arrow 56) along the seal assembly 30, the shear blade 12 may contact the energizer 54 and force the energizer in a direction (e.g., upward) away from the shear blade 12, as shown by arrow 90. The sloped surface 80 of the energizer 54 may enable this transition from the lateral force of the shear blade 12 against the energizer 54 to the vertical movement 90 of the energizer 54. In addition, the sloped surface 80 may facilitate a gradual activation of the sealing element 52.

This movement 90 of the energizer 54 may push against the sealing element 52, causing the sealing element 52 to deform into a sealing engagement with the sealing surface of the shear blade 12. This deformation is illustrated via arrow 92. The sealing element 52 may be constructed from rubber or some other elastomeric material that can deform in response to movement of the energizer 54 and form a fluid-tight seal upon its activation.

The energizer 54 may displace a relatively large amount of material of the sealing element 52 upon its activation, compared to the wiper 50 upon its activation. This is due in part to the energizer 54 having a larger width that the wiper 50, allowing the energizer 54 to compress a larger surface area of the sealing element 52. In addition, as shown in FIG. 3A, the sealing element 52 may have a larger thickness disposed between the energizer 54 and the shear blade 14 than between the wiper 50 and the shear blade 14. Further, the energizer 54 may extend relatively further out from the shear blade 14 than the wiper 50 when in the fully extended position of FIG. 3A, enabling the shear blade 12 to push the energizer 54 further toward the sealing element 52.

As a result of this construction, when the shear blade 12 pushes against the energizer 54, the energizer 54 may displace a relatively large amount of the sealing element 52 toward the shear blade 12 to energize the seal. The wiper 50, on the other hand, may only displace enough of the sealing element 52 to cushion the movement of the wiper 50 and bias the wiper 50 toward the shear blade 12, without the sealing element 52 moving into contact with the seal blade 12. Thus, the sealing element 52 may remain above the level of the shear blade 12 until the energizer 54 activates the sealing element 52.

In some embodiments, the energizer 54 may include another sloped surface 94, which faces and abuts the sealing element 52. This sloped surface 94 may help direct the sealing element 52 as it is pushed by the energizer 54. That is, the sloped surface 94 may direct the sealing element 52 to deform in a direction toward the cleaned sealing surface of the shear blade 12.

Figure 4:
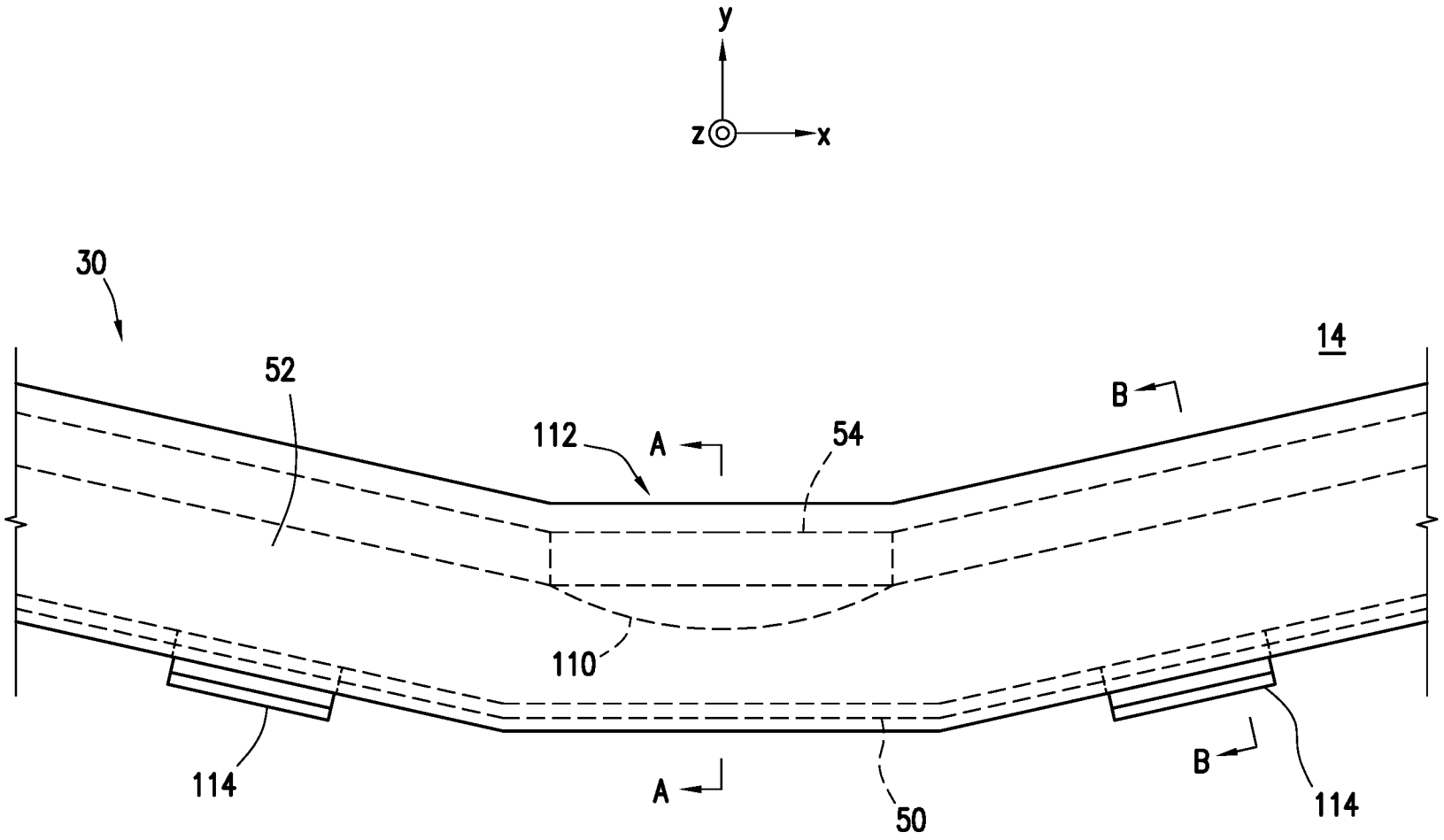
FIG. 4 is an above view of the components that make up the lateral seal of FIG. 2, in accordance with an embodiment of the present disclosure.

FIGS. 3A-3C represent only a cross section of the seal assembly 30 disclosed herein. It should be noted that the seal assembly 30 may be designed to extend along an entire width of the shear blade 14. Various shapes and arrangements of the seal assembly 30 may be provided in different embodiments. As one example, FIG. 4 is a top view of an embodiment of the seal assembly 30 having the wiper 50, the sealing element 52, and the energizer 54 disposed along the shear blade 14 in a curved shape. That is, the cross section of the seal assembly 30 described above with respect to FIGS. 2-3 may extend along a relatively curved or angled shape. This seal assembly 30 may create a seal along a relatively curved path between the shear blades 12 and 14.

In some embodiments, it may be desirable for the seal assembly 30 to be disposed along the shear blade 14 in a shape that matches or substantially matches a blade profile of the opposing shear blade 12. For example, the curved seal assembly 30 provided in FIG. 4 may substantially track a shape of the blade profile of the shear blade 12 shown in FIG. 1. This may enable the shear blade 12 to energize the entire seal assembly 30, thereby activating the seal between the entire width of the shear blades 12 and 14, at the same time or approximately the same time.

In other embodiments, the seal assembly 30 may be shaped to extend relatively straight across the width of the shear blade 14 while the other shear blade 12 is curved, or the seal assembly 30 may be curved (e.g., FIG. 4) while the shear blade profile is straight across. This may enable the seal assembly 30 to seal the shear blade 12 against the shear blade 14 initially at a central point along a width of the shear blades 12 and 14, and to complete the seal in an outward direction to seal the entire width of the shear blades 12 and 14. In other embodiments, this may enable the seal assembly 30 to seal the shear blades 12 and 14 starting at the edges of the width of the ram unit and moving toward a central point of the width. It should be noted that still other arrangements of the seal assembly 30 relative to one or both of the shear blades 12 and 14 may be utilized in other embodiments to seal the entire width of the shear blades 12 and 14.

As shown in FIG. 4, the energizer 54 may include a lip 110 extending outward from the energizer 54 in a direction of the sealing element 52. In the illustrated embodiment, this lip 110 is disposed at a central portion 112 along the width of the shear blade 14. The lip 110 may be slightly curved, as shown, or may be angled to extend straight outward and across a portion of the seal assembly 30.

The lip 110 of the energizer 54 may prevent the sealing element 52 from deforming into an exposed space between the shear blades 12 and 14 that is present when the shear blades 12 and 14 are in a closed position for forming the seal. For example, in the ram unit 10 of FIG. 1, the shear blades 12 and 14 have blade profiles with cutouts toward the center, facing each other. As the shear blades 12 and 14 are brought together and begin overlapping, these cutouts may overlap as well such that an opening is left between the shear blades 12 and 14 when the shear blade energizes the seal. Accordingly, the lip 110 of FIG. 4 may prevent the sealing element from extruding into the space between the two shear blades 12 and 14 when the energizer 54 pushes on the sealing element 52 to activate the seal.

Figure 5A:
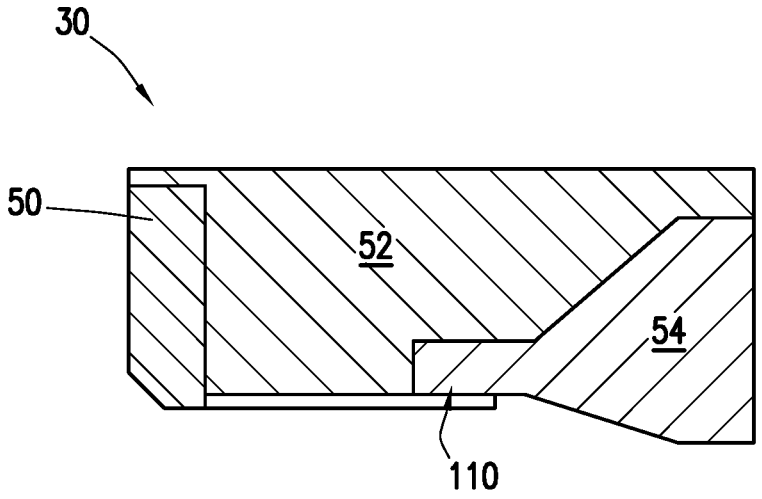
FIGS. 5A and 5B are cross sectional views of different portions of the lateral seal assembly of FIG. 4, in accordance with embodiments of the present disclosure.

FIG. 5A is a cross sectional view of the central portion 112, showing the lip 110 extending outward from the energizer 54. As illustrated, the lip 110 may extend from a lower position on the energizer so that the lip 110 can keep the sealing element from deforming downward into a location below the lip 110 (e.g., space between the shear blades).

Figure 5B:
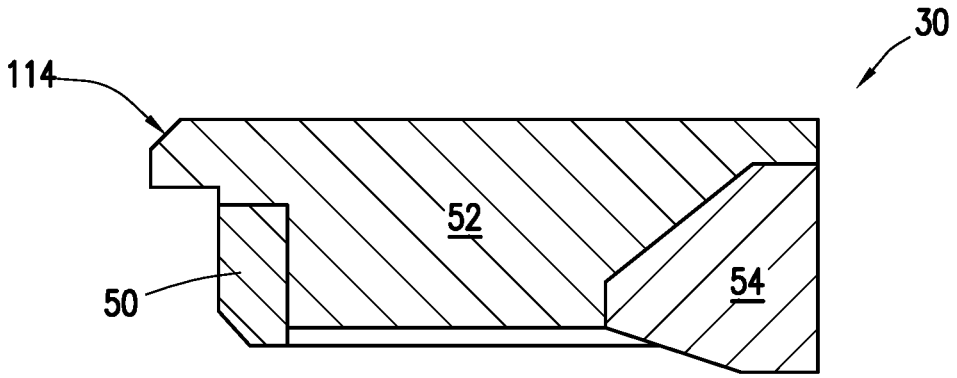

FIG. 4 also shows two extensions 114 of the sealing element 52 that may extend outward from the seal assembly 30 and interface with the wiper 50. FIG. 5B is a cross sectional view of the seal assembly 30 at a location of one of the extensions 114. As shown in FIG. 5B, the energizer 54 at this position along the seal assembly 30 may not have the extended lip (110 of FIG. 5A) described above. As shown, the extension 114 of the sealing element 52 may provide a relatively large cushion for the wiper 50 disposed below the extension 114. This may provide a desired amount of flexibility in the movement of the wiper 50 as the shear blade is brought into contact therewith.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

What is claimed is:

1. A blowout preventer, comprising:

a ram unit comprising a first shear blade and a second shear blade, wherein the ram unit is configured to force the first shear blade and the second shear blade together to shear and seal a wellbore tubular disposed within the ram unit, wherein the second shear blade comprises a seal assembly for sealing a space between the first shear blade and the second shear blade in response to the ram unit forcing the first shear blade and the second shear blade together, wherein the seal assembly comprises:

a wiper to clean a surface of the first shear blade;

a sealing element to generate a seal between the surface of the first shear blade and the second shear blade; and an energizer to energize the sealing element against the surface of the first shear blade wherein the energizer comprises a sloped surface that presses on the sealing element in response to the first shear blade moving relative to the second shear blade.

2. The blowout preventer of claim 1, wherein the wiper is configured to be initially activated prior to energizing the seal via the first shear blade moving relative to the second shear blade.

3. The blowout preventer of claim 1, wherein the wiper comprises a first end extending away from the second shear blade and configured to interface with the first shear blade, and wherein a portion of the sealing element is disposed between a second end of the wiper opposite the first end and the second shear blade to cushion a movement of the wiper in response to the first shear blade pushing on the first end of the wiper.

4. The blowout preventer of claim 3, wherein the first end of the wiper comprises a sloped surface for trapping debris within a space between the second shear blade and the wiper.

5. The blowout preventer of claim 1, wherein the energizer comprises a first portion extending away from the second shear blade for interfacing with the first shear blade.

6. The blowout preventer of claim 5, wherein the first portion of the energizer comprises a second sloped surface for facilitating a gradual activation of the sealing element.

7. The blowout preventer of claim 5, wherein the first portion of the energizer extends further from the second shear blade than the wiper.

8. The blowout preventer of claim 1, wherein the energizer comprises a lip extending toward a center of the second shear blade to prevent the sealing element from extruding into a space between the first and second shear blades.

9. The blowout preventer of claim 1, wherein the seal assembly is disposed along the second shear blade in a curved shape.

10. The blowout preventer of claim 1, wherein the seal assembly is disposed along the second shear blade in a shape that matches a blade profile of the first shear blade.

11. The blowout preventer of claim 1, wherein the seal assembly is disposed straight across a width of the second shear blade, and wherein a blade profile of the first shear blade is curved.

12. A method, comprising:

actuating a ram unit of a blowout preventer to move a first shear blade of the ram unit and a second shear blade of the ram unit toward each other;

cleaning a surface of the first shear blade via a wiper of a seal assembly disposed on the second shear blade, in response to the first shear blade moving relative to the second shear blade;

energizing a sealing element of the seal assembly against the surface of the first shear blade via an energizer of the seal assembly by pressing on the sealing element via a sloped surface of the energizer in response to the first shear blade moving relative to the second shear blade; and sealing the first and second shear blades against one another via the sealing element.

13. The method of claim 12, further comprising energizing the sealing element against the surface of the first shear blade after cleaning the surface of the first shear blade.

14. The method of claim 12, further comprising:

removing debris from the surface of the first shear blade via the second shear blade as the first and second shear blades are moved relative to each other, wherein the debris that is removed cannot fit through a space between the overlapping first and second shear blades; and removing residual debris from the surface of the first shear blade via the wiper.

15. The method of claim 12, further comprising pushing the wiper toward the second shear blade via the first shear blade moving relative to the second shear blade, and biasing the wiper toward the first shear blade via a portion of the sealing element.

16. The method of claim 12, further comprising engaging a second sloped surface of the energizer via the first shear blade to gradually energize the sealing element.

17. The method of claim 12, further comprising sealing an entire width of the first shear blade against an entire width of the second shear blade at approximately the same time.

18. The method of claim 12, further comprising sealing the first shear blade against the second shear blade initially at a central point along a width of the first and second shear blades and completing the seal in an outward direction to seal the entire width of the first and second shear blades.

19. The method of claim 12, further comprising preventing the sealing element from extruding into a space between the first and second shear blades via the energizer.

* * * * *